US005355638A

United States Patent [19]

Hoffman

[11] Patent Number: 5,355,638

[45] Date of Patent: Oct. 18, 1994

[54] TRACTION DRIVE CENTRIFUGAL FINISHER

[76] Inventor: Steve E. Hoffman, 6 Maple St., Englewood Cliffs, N.J. 07632

[21] Appl. No.: 941,695

[22] Filed: Sep. 8, 1992

[51] Int. Cl.[5] ..... B24B 1/00

[52] U.S. Cl. ..... 451/32; 451/326; 451/327

[58] Field of Search ..... 51/163.1, 163.2, 164.1, 51/164.2, 314, 315, 316

[56] References Cited

U.S. PATENT DOCUMENTS

| | | | |
|---|---|---|---|
| 1,146,269 | 7/1915 | Mauss . | |
| 1,491,601 | 4/1924 | Fuller | 51/164.2 |
| 1,538,231 | 5/1925 | Abbott . | |
| 1,665,065 | 4/1928 | Malloy . | |
| 1,688,555 | 10/1928 | Rankin . | |
| 2,131,732 | 10/1938 | Hammell . | |
| 2,204,039 | 6/1940 | Francois . | |
| 3,013,365 | 12/1961 | Harper . | |
| 3,341,979 | 9/1967 | Davidson et al. | 51/164.2 |
| 3,474,574 | 10/1969 | Ohno . | |
| 3,503,157 | 3/1970 | Harper . | |
| 3,609,921 | 10/1971 | Foster et al. | 51/164.2 |
| 4,308,693 | 1/1982 | Harper | 51/164.2 |
| 4,328,600 | 5/1982 | Bochan . | |
| 4,615,148 | 10/1986 | Harper, Jr. | 51/164.2 |
| 4,665,661 | 5/1987 | Kobayashi et al. | 51/164.2 |
| 4,776,135 | 10/1988 | Thum, III et al. | 51/164.2 |

*Primary Examiner*—M. Rachuba
*Attorney, Agent, or Firm*—Fred A. Keire; Brenda Pomerance

[57] ABSTRACT

A centrifugal finisher having an outer vessel and at least one inner vessel includes a traction surface between the inner surface of the outer vessel and the outer surface of each inner vessel. The inner vessels revolve about the axis of the outer vessel, and rotate about their own internal axes. The traction surface permits the outer wall to restrain the inner vessels and simultaneously causes the rotation of the inner vessels through interaction with the outer vessel, which can be stationary or moving at a different rotational speed and/or at a different rotational direction than the part which revolves the inner vessels.

36 Claims, 7 Drawing Sheets

TRACTION DRIVE CENTRIFUGAL FINISHER

FIELD OF THE INVENTION

The present invention relates to apparatus for finishing the surface of an object or objects by contact with abrasive pieces caused by centrifugal and rotational forces. More specifically, the present invention relates to polishers having an outer barrel containing several inner barrels which revolve about the axis of the outer barrel and also rotate about their own internal axes.

BACKGROUND OF THE INVENTION

When a vessel revolves about an external axis and also rotates about its internal axis, the contents of the vessel, typically abrasive pieces and objects to be finished by contact with the abrasive pieces, experience centrifugal and rotational forces. The centrifugal force relates to the pressure experienced by the contents, while the rotational force relates to the speed of the contents relative to each other. Various types of finishes can be achieved due to the presence of the centrifugal and rotational forces. Furthermore, centrifugal finishers having several separate inner vessels within an outer vessel are useful when objects being finished need to be kept separated from each other for identification or functional reasons, or when different types of abrasive pieces are used simultaneously on separate objects.

Machines for subjecting objects to both centrifugal and rotational forces are well known. One type of machine relies strictly on a complicated set of gears, such as planetary gears, and is limited to a particular ratio of revolutional speed to rotational speed. This apparatus is complicated since it requires many parts and is quite noisy. Also, the number of vessels is fundamentally constrained for a certain gear ratio, since as the number of vessels increases (the footprint of each vessel decreases), the gear size must also increase until the gears bump into each other. If the gear ratio is increased, finer gears are required, and the strength of the gear material becomes a constraint.

Another type of machine creates centrifugal force by revolving a vessel around a shaft and creates rotational force using a belt wrapped around the shaft and the exterior of the vessel. Here, the speed of the belt is related to the speed of the shaft. Furthermore, mechanical failures occur due to the high stress sustained by the belt and/or parts restraining the vessel. Overheating is also common in these machines.

None of these prior art machines permits separate control, over a wide range, of the rotational and centrifugal forces experienced by the contents of a vessel using an apparatus of simple construction which operates quietly and in which the parts are not subjected to high stress.

BRIEF DESCRIPTION OF PRIOR ART

U.S. Pat. No. 1,146,269 (Mauss) describes an inner drum attached to a first toothed wheel secured to a main frame which revolves around the axis of the main frame. A second toothed wheel geared to the inner drum is coaxial with the first toothed wheel and rotates therewith. The gearing arrangement is limited to a predetermined ratio. Each inner drum is supported at the center of its base, and constrained to an essentially upright position at its top.

U.S. Pat. No. 1,538,231 (Abbott) shows articles to be burnished screwed to work fixtures which rotate about a shaft which is revolved about a central axis by a system of gears. The shaft is supported at both ends, but each article is supported only by being screwed in place.

U.S. Pat. No. 2,131,732 (Hammell) relates to a tumbling mill having barrels with rotatable heads mounted on discs with sprockets engaged with a continuous belt. While one barrel is being charged with abrasives, a second barrel is rotating its contents and a third barrel is discharging its contents. At some point, a central wheel moves by a step so that each barrel advances to the next stage. Here, the contents of each barrel are finished by rotational force, since each barrel is not revolved while it rotates.

U.S. Pat. No. 2,204,039 (Francois) relates to a grain treatment apparatus having an outer cylinder with elliptical cross-section rotatably mounted on a shaft. An inner cylinder is coaxially mounted on the shaft. Blades carried by shafts mounted in bearing which are supported by the end walls of the outer cylinder are provided to stir the grain, which may move throughout the interior of the outer cylinder. That is, this apparatus has no inner vessels.

U.S. Pat. No. 3,013,365 (Harper) describes two rotatable drums mounted between a pair of impellers on opposite sides of a shaft. The impellers rotate, thereby revolving the drums and applying centrifugal force to the contents of the drum. Each drum has a separate chain looped around the shaft and a toothed disc at the base of the drum coaxial therewith; when the shaft moves, the drum is rotated by motion imparted through the chain. Substantial heat is generated during operation.

U.S. Pat. No. 3,474,574 (Ohno) shows inner containers rotated by motion imparted from a central shaft through gears. The drum containing the inner containers is itself rotated by a belt looped around its outside.

U.S. Pat. No. 3,503,157 (Harper) relates to an orbital finishing machine having two barrels which revolve around a common shaft and also rotate about their own axes due to motion imparted by a respective pair of resilient belts looped around each barrel. The belts fit in grooves on the outside of the barrels and limit the outward radial movement of the barrels. Consequently, the belts are under high stress.

BRIEF SUMMARY OF THE INVENTION

One advantage of the present invention is that it has a simple design and does not rely on a system of gears.

Another advantage of the present invention is that it may be operated at very high speed.

A further advantage of the present invention is that it permits centrifugal force to dissipate through its outer vessel, resulting in reduced vibration and quieter operation than prior art systems and avoiding high stress at any individual component.

In accordance with one aspect of the present invention, a centrifugal finisher for finishing at least one object comprises: an outer vessel having an inner surface and an axis; at least one inner vessel inside the outer vessel for containing the objects to be finished and having an outer surface; driving means for revolving each inner vessel around the axis of the outer vessel; and at least one traction surface for engaging the inner surface of the outer vessel with the outer surface of the inner vessel when each inner vessel is revolved by the driving means, thereby causing each inner vessel to rotate.

BRIEF DESCRIPTION OF THE DRAWINGS

The following detailed description, given by way of example and not intended to limit the present invention solely to the embodiment shown and described herein, will best be understood in conjunction with the following drawings in which.

DETAILED DESCRIPTION OF THE PREFERRED EMBODIMENTS

The present invention is applied in a centrifugal finisher or polisher having an outer vessel and at least one inner vessel which revolves about the axis of the outer vessel and rotates about its own axis, and resides in the provision of a traction surface between the inner surface of the outer vessel and the outer surface of the inner vessel. The traction surface allows the outer vessel to restrain the inner vessel while the latter experiences centrifugal forces, and, simultaneously, causes the rotational movement of the inner vessel by transferring momentum from the outer vessel to the inner vessel, since the outer vessel is rotating, if at all, at a different rotational speed and possibly in a different direction than the rotational movement causing the revolution of the inner vessel.

The traction surface completely eliminates the need for a complicated gearing system or a separate belt for each internal vessel, resulting in a simpler apparatus with reduced maintenance requirements relative to the prior art. As discussed below, a top speed of about 6000 rpm is believed to be attainable. Furthermore, due to the design flexibility conferred by use of the traction surface, the inner vessels can be of different sizes relative to each other so that they rotate at different speeds. Also, the ratio of the rotational speed to revolutional speed for an inner vessel can be controlled to be any value within a wide range, since there are two essentially independent ways to control such motion.

Use of the traction surface, which allows direct interaction between the outer and inner vessels, greatly reduces overall vibration resulting in cooler and quieter operation as compared with prior art machines. A machine according to the present invention produces about as much noise as an electric fan or electric typewriter which is on but not in use. No overheating problem has occurred in any use of a machine according to the present invention. Furthermore, no appreciable wear in parts has been observed after about 500 hours of operation. Objects suitable for finishing in an apparatus according to the present invention include anything which fits in an inner vessel. A prototype machine according to the present invention has been used successfully to finish items as large as human knee joint replacements and as small as pencil point-sized items used in altimeter sensors.

Figure 1:
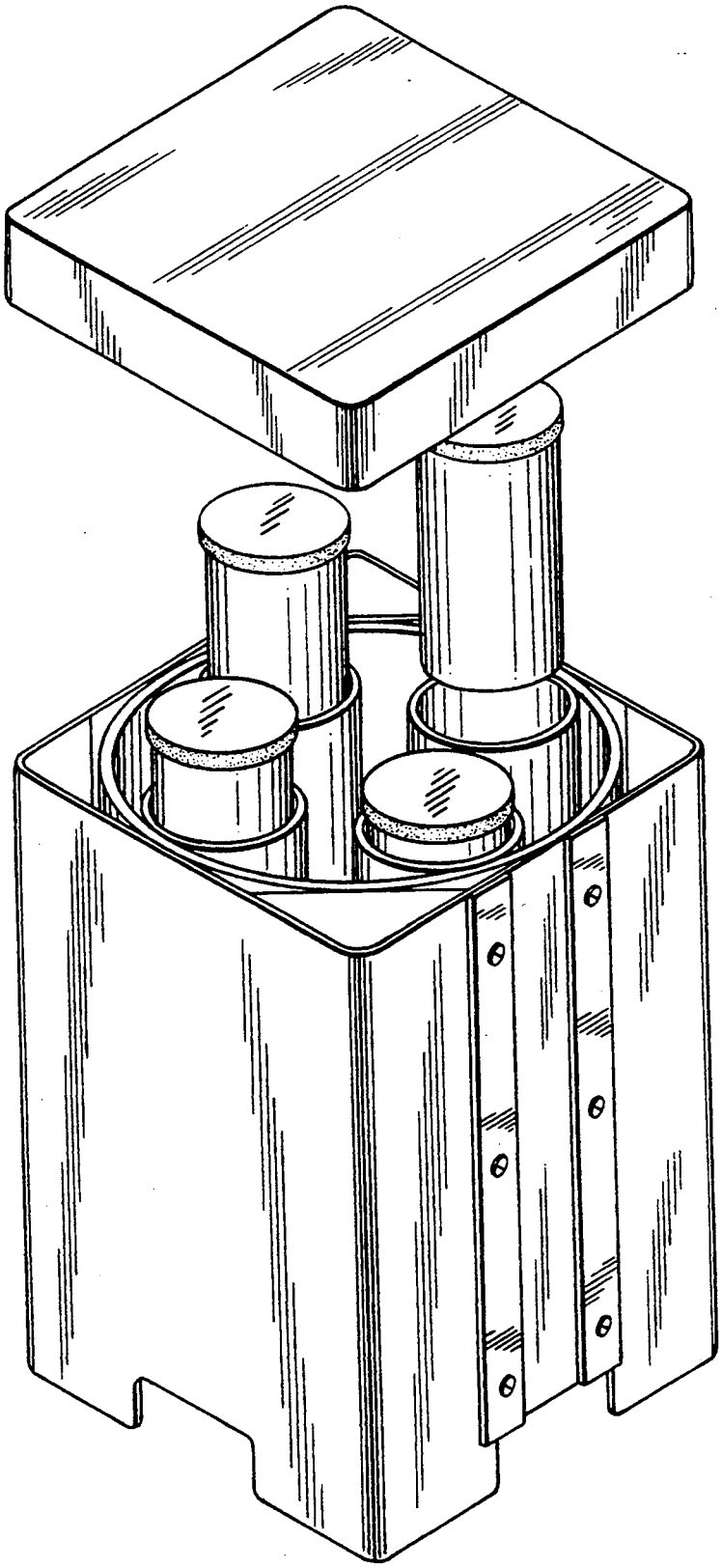
FIG. 1 is an external view of an apparatus according to the present invention.
Figure 2A:
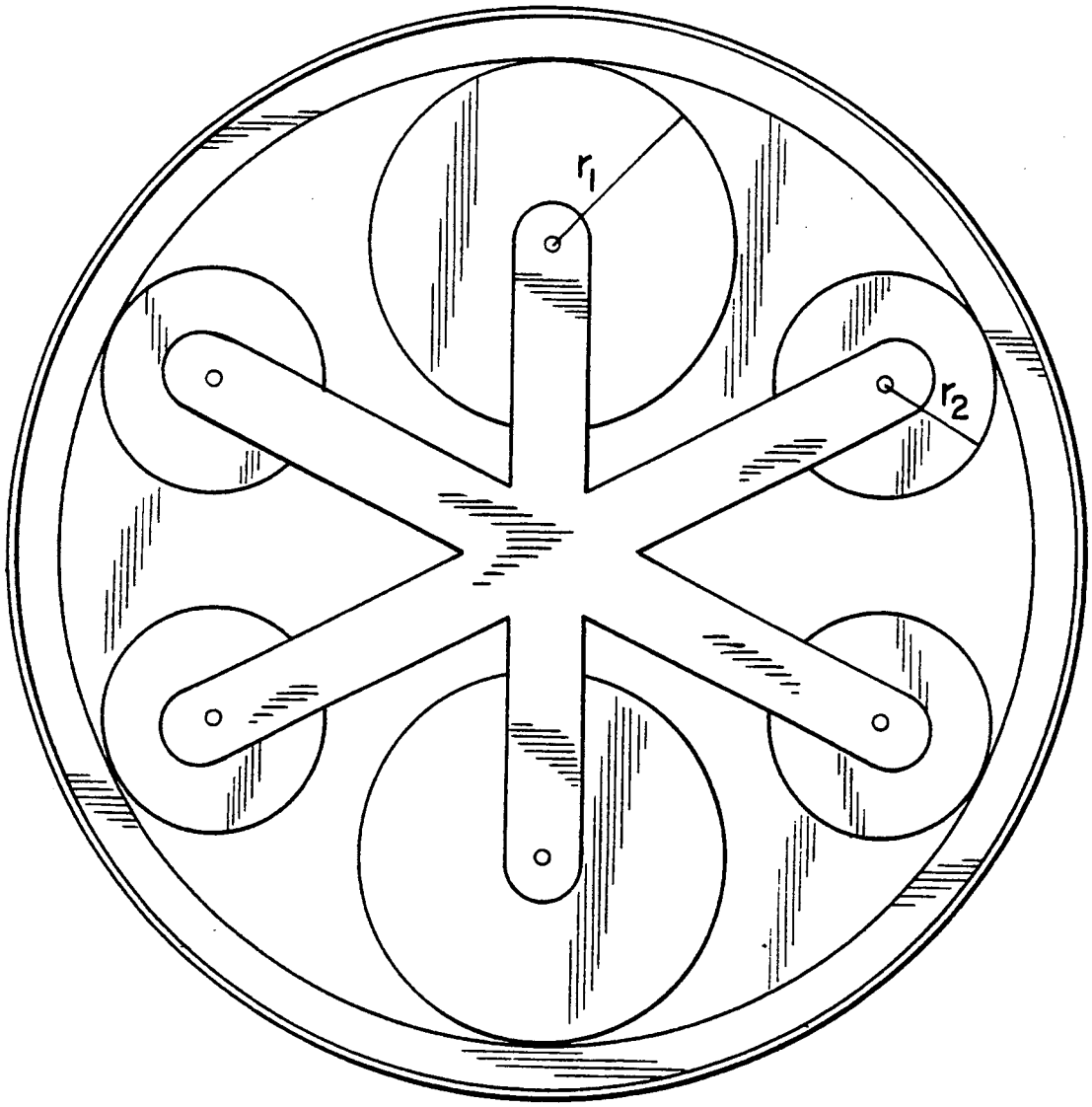
FIG. 2A is a cross-sectional view of a variation of the apparatus shown in FIG. 1.

An external view of an apparatus according to the present invention is shown in FIG. 1. An outer housing, shown as being fitted with a cover, contains an outer cylindrical vessel. Four inner cylindrical vessels are shown within the outer vessel, although this number may be readily varied. The shape and size of the inner vessels may also be varied, e.g., each vessel may be conic and of different diameter than at least one other inner vessel. For example, FIG. 2A shows a configuration in which one inner vessel has a radius r1 and another inner vessel has a radius r2, with r1 different than r2. Each inner vessel is shown as receiving a covered flask containing objects to be finished along with abrasive media. The contents of each flask may be different, permitting simultaneous use of different finishing media in wet or dry processes and facilitating individual object identification, which is required for certain objects having medical use. Alternatively, the object or objects to be finished, along with the appropriate abrasive media, may be loaded directly into an inner vessel.

The abrasive media may include compressed felt chunks having a particulate abrasive coating material thereon, such as those described in U.S. Pat. No. 5,140,783, haivng a common inventor herewith, and which is incorporated herein by reference.

Figure 2B:
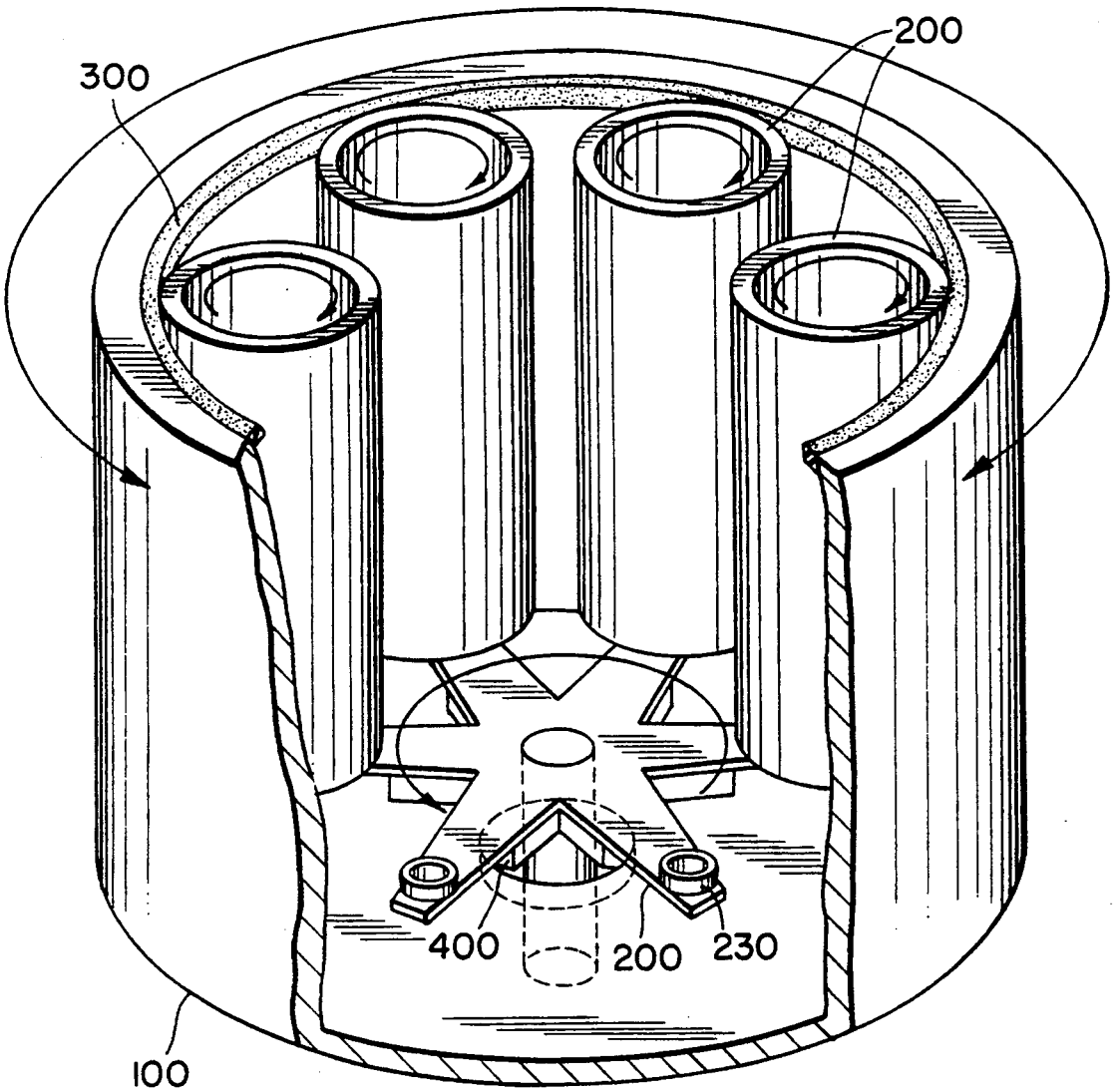
FIG. 2B is an isometric cutaway view of a variation of the apparatus shown in FIG. 1.

FIG. 2B shows an isometric cutaway view of a variation of the apparatus shown in FIG. 1 having six inner vessels, rather than four, including an outer vessel 100, inner vessels 200, a traction surface 300 and a connection member 400. Each inner vessel 200 is mounted on a respective bearing 230 that is itself mounted on a respective arm 220 connected to the connection member 400, shown as a hub located at the axis of the outer vessel 100. A shaft 260, which passes through a hole in the center of the bottom of outer vessel 100, at the axis of the outer vessel 100, is indicated to be attached to the underside of connection member 400.

In operation, shaft 260 is rotated by a motor, not shown, causing connection member 400 to rotate. When connection member 400 rotates, the inner vessels 200 revolve about the axis of the outer vessel 100 and experience centrifugal force which exerts outward pressure on them. Each arm 220 is made of a flexible material having flexure in one direction, such as spring steel or plastic, and bends slightly downward under the influence of the outward centrifugal pressure, permitting the top rim of the outer surface of each inner vessel 200 to rest against the inner surface of the outer vessel 100. The arm 220 restricts the lateral or torsional movement of the inner vessel 200.

A traction surface 300, consisting of a band of a resilient and relatively soft material having a high coefficient of static friction, such as rubber, is located at the top rim of the inner surface of the outer vessel 100, which is where the centrifugal force from each inner vessel 200 may be most effectively dissipated. It is important that the material used for the traction surface prevent a sliding contact. When each inner vessel 200 leans outward, contact is made between the inner vessel 200 and the traction surface 300, thereby positively engaging the inner surface of the outer vessel 100 with the outer surface of each inner vessel 200. The traction surface may have a range of compressibility, from soft to rigid, depending on the application. Excellent results have been obtained using a traction surface having approximately 80 shore A hardness.

When contact with the traction surface 300 occurs, the majority of the centrifugal stress experienced by the inner vessel 200 is removed from the bearing 230. A variety of structures, known to a skilled person, are suitable for use as bearing 230, including a ball bearing, a fluid bearing, a magnetic bearing and a bearing comprising metal impregnated with oil such as a bronze Babbitt bearing.

The movement, if any, of the outer vessel 100 is imparted to each revolving inner vessel 200 through the traction surface 200, causing each inner vessel 200 to rotate about its respective bearing 230. Thus, the contents of each inner vessel 200 experience both centrifugal and rotational forces. These forces may be varied to optimize the effectiveness of the finishing or polishing process for different objects and different media.

Figure 3A:
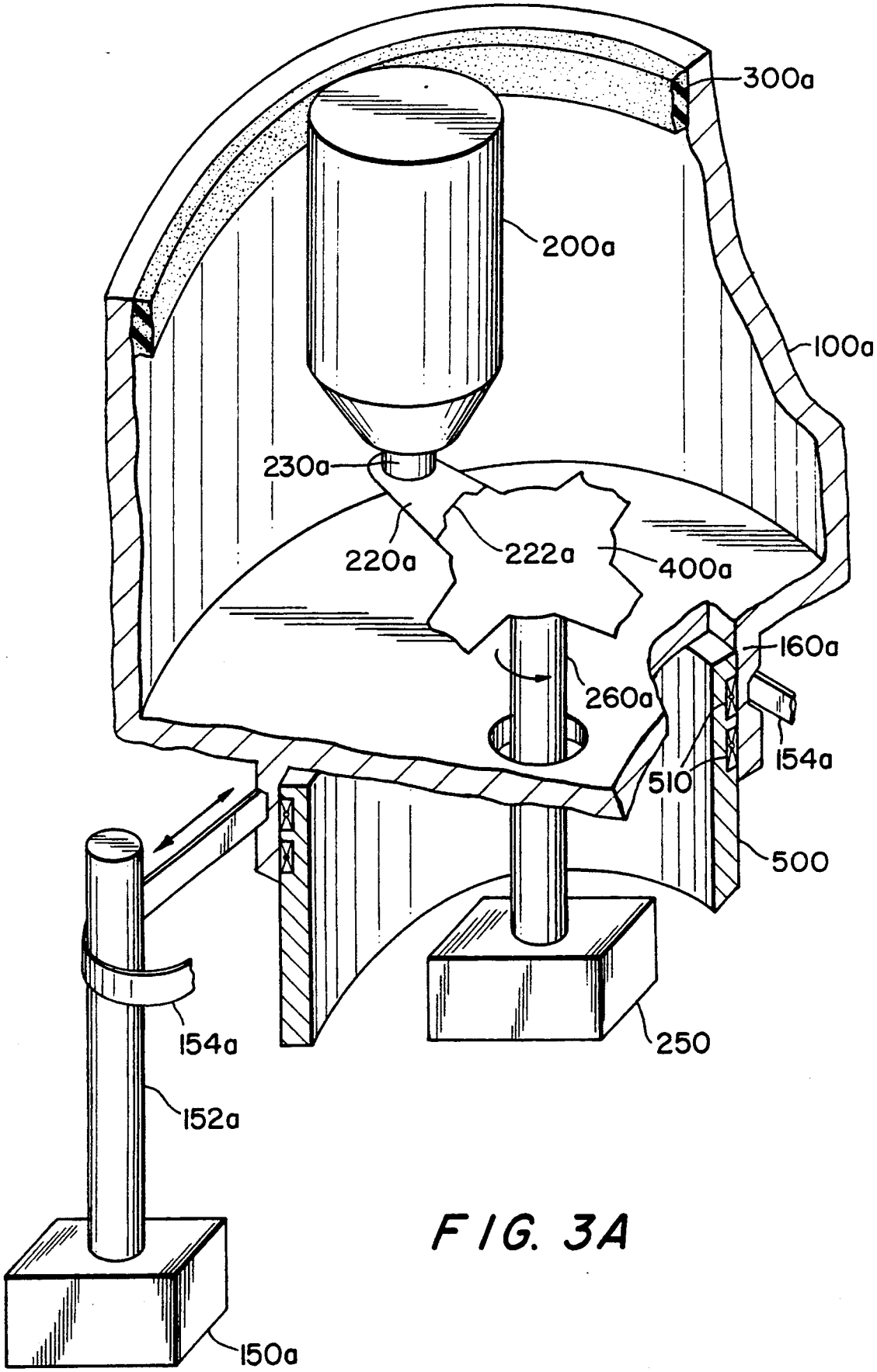
FIGS. 3A and 3B are cutaway view of different arrangements for creating motion in the apparatus of FIG. 1.

FIG. 3A, which is a cutaway view of the apparatus of FIG. 1, shows the present invention in greater detail. A motor 250*a* rotates a shaft 260*a* affixed to the underside of connection member 400*a*. Each inner vessel 200*a* is mounted on a bearing 230*a* connected to a respective arm 220*a* which includes a hinge 222*a* interlocking with the connection member 400*a*. The bottom of the inner vessel 200 is a gusset, for improved rigidity.

The rotation of connection member 400*a* causes each inner vessel 200*a* to revolve about the axis of outer vessel 100*a* creating centrifugal pressure which causes the hinge 222*a* to bend downwards until the rim of the outer surface of inner vessel 220*a* contacts a traction surface 300*a* on the inner surface of outer vessel 100*a*.

Outer vessel 100*a* is shown as having a shaft 160*a* extending from its underside. The inner surface of the shaft 160*a* rests against a stationary member 500*a* which has at least one sleeve of ball bearings 510 in its outer surface. The outer surface of the shaft 160*a* is in contact with a belt 154*a* that loops around a shaft 152*a*. A motor 150*a* rotates the shaft 152*a* at a rotational speed and in a rotational direction which may be set completely independently of the rotational speed and direction of motor 250*a*. The belt 154*a* transfers the rotation of shaft 152*a* to shaft 160*a*. The ball bearings 510 permit shaft 152*a* to rotate freely. Additional ball bearings may be included in the top surface of stationary member 500, so as to reduce friction with the underside of outer vessel 100*a*. The details of this arrangement may be adapted in various ways by a skilled person to enable various independent or dependent movements of shafts 160*a* and 260*a*.

Figure 3B:
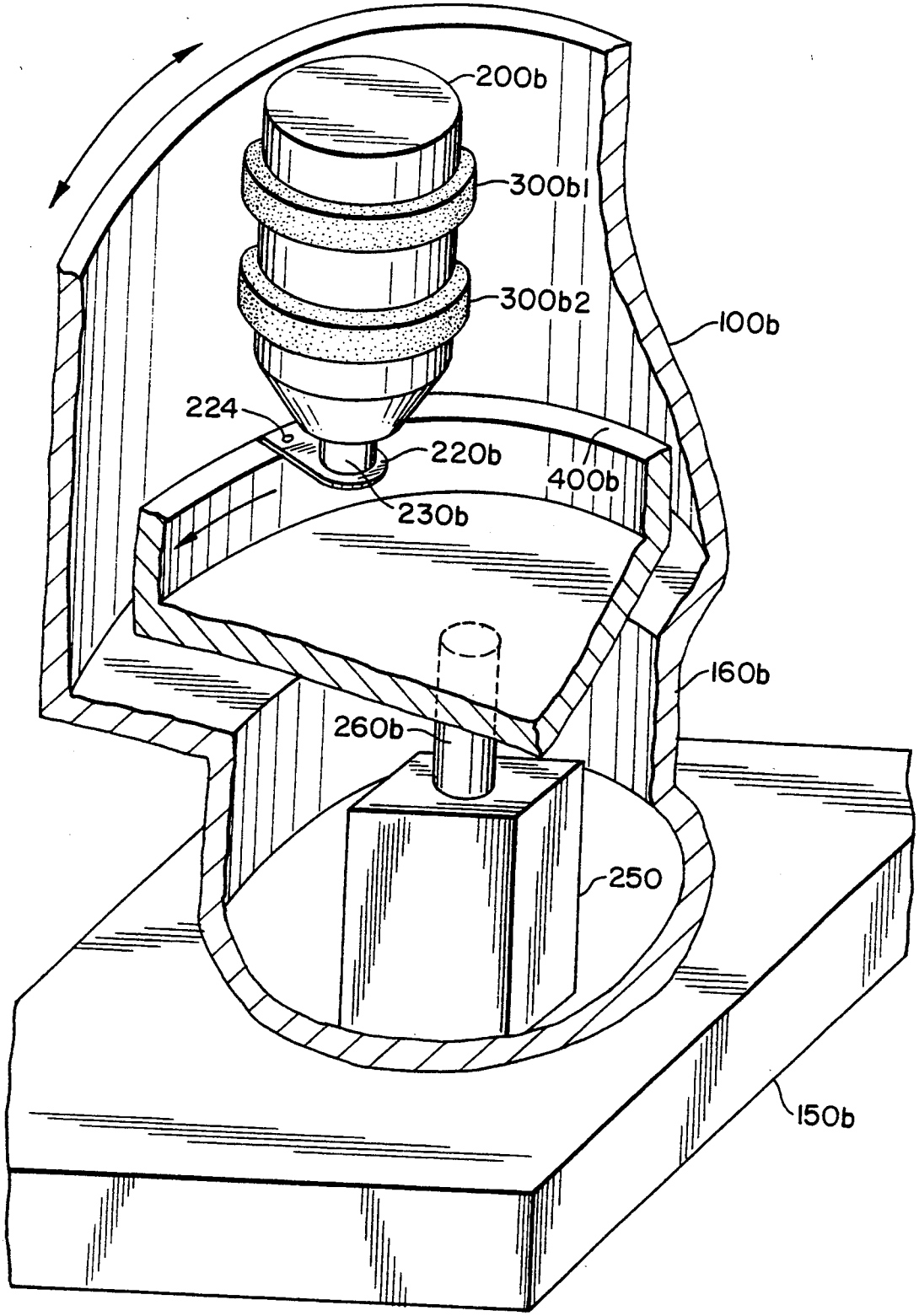

FIG. 3B is an alternative embodiment of the apparatus shown in FIG. 3A. Each inner vessel 200*b* is shown as having two frictional members 300*b*1, 300*b*2 wrapped around its outer surface. The frictional members 300*b*1, 300*b*2 are of different thickness, and comprise a traction surface. The inner vessel 200*b* is mounted on a bearing 230*b* connected to an arm 220*b* made of a flexible material having flexure in one direction. The arm 220*b* is connected to connection member 400*b* by a fastener 224*b*, which may be a screw. Connection member 400*b* is shown as a ring coaxial with outer vessel 100*b* and has a shaft 260*b* projecting from its underside.

Shaft 260*b* is rotated by motor 250*b*, causing inner vessel 200*b* to revolve about the axis of outer vessel 100*b*. The centrifugal pressure created during revolution causes the arm 220*b* to bend downwards while inner vessel 200*b* inclines outwards until at least one of its frictional members 300*b*1, 300*b*2 contacts the inner surface of outer vessel 100*b*.

Outer vessel 100*b* has a shaft 160*b* projecting from its underside, shown as enclosing but not being connected to the motor 250*b* and the shaft 260*b* so that shafts 160*b* and 260*b* are coaxial. The shaft 160*b* is independently rotated by a motor 150*b* shown as being independent of motor 250*b*, although one skilled in the art may readily vary this driving arrangement.

The rotation of the outer vessel 100*b* caused by motor 150*b* is imparted to the inner vessel 200*b* by the engagement of the inner surface of the outer vessel 100*b* with the outer surface of the inner vessel 200*b* through the traction surface comprising frictional members 300*b*1, 300*b*2 wrapped around the inner vessel 200*b*. Thus, the contents of each inner vessel 200*b* experience both centrifugal and rotational forces.

A centrifugal disk finisher according to the present invention may controlled by a timer so as to permit a sequence of polishing operations.

Figure 4:
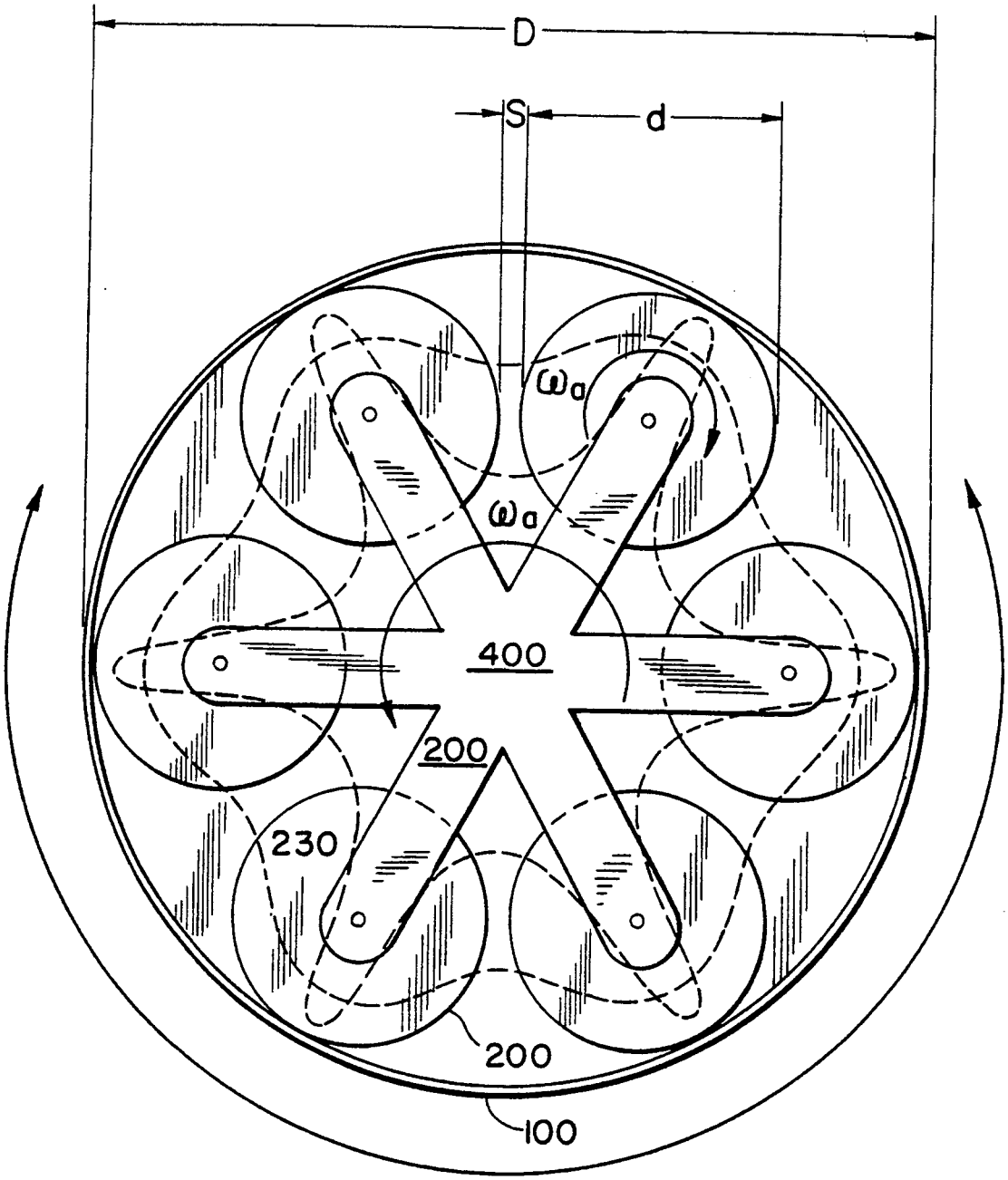
FIG. 4 is a cross-sectional view of the apparatus shown in FIG. 2B.

FIG. 4 is a cross-sectional view of the apparatus shown FIG. 2B. The outer vessel 100 has an inside diameter D, while each inner vessel has an outside diameter d. The spacing between the outer surfaces of the inner vessels is shown as s. When the number of inner vessels 200 is chosen as n, the diameter D of the outer vessel 100 is given by the following expression:

$$D = \frac{(d+s)}{\sin(\pi/n)} + d$$

The outer vessel 100 has a rotational speed of $\omega_D$ in a clockwise or counter-clockwise direction. The connection member 400 has a rotational speed of $\omega_a$ in a counter-clockwise direction. Consequently, the rotational speed of each inner vessel $\omega_d$ is given by the following expression:

$$\omega_d = \frac{D}{d}(\omega_a - \omega_D)$$

A negative value for any of the rotational speeds indicates a rotational direction counter to that indicated by a positive value. The rotational speed $\omega_d$ of an inner vessel 200 may be increased to any desired value by rotating the outer vessel 100 counter to the direction of rotation of the connection member 400, that is, giving $\omega_D$ a negative value relative to $\omega_a$. Alternatively, the rotational speed of the inner vessel may be decreased by rotating the outer vessel 100 in the same direction of rotation as the connection member 400.

Typical values for these parameters are an outer vessel inner diameter D of about 14 inches, an inner vessel outer diameter d of about 6 inches, a spacing s between inner vessels of about 0.25 inches, and a number n of inner vessels of about 4. The rotational speed $\omega_d$ of an inner vessel is usually in the range of 150–750 rpm, with a typical value being approximately in the middle of this range, but other values are certainly feasible with the limitation being what the bearing 230 can sustain. For example, a magnetic bearing may be used, and can sustain a top speed of about 6000 rpm. Centrifugal forces from several g (gravitational units) to several hundred g may be obtained.

In the prototype machine, the outer vessel weighs about 150 lbs. empty and each inner vessel weighs about 4 lbs. empty and receives a load of about 20 lbs., but smaller or larger vessels and loads are readily accommodated. Also, each arm in the prototype is a leaf spring having a spring constant of about 0.001 lbs./inch, but the invention is not restricted to this value. Alternatively, if a hinge is used, it must have sufficient ridigity to maintain the positions of the barrels.

The path of an object in an inner vessel 200 which is rotating and revolving describes a prolate cycloid, of which two typical examples are shown by dashed lines in FIG. 4. Variation of the inner vessel rotational speed $\omega_d$ alters the number of lobes in the cycloid for each rotation of the connection member 400.

An optimal ratio of rotational speeds $\omega_D/\omega_d$ has been found to be about 1.5. At the optimal ratio, the lobes of the prolate cycloid are fairly flat, meaning that the contents of the inner vessel 200 generally are away from the walls of the vessel. If the ratio of rotational speeds is too high, the contents of the inner vessel stay against the walls of the vessel, and little or no finishing occurs. If the ratio of the rotational speeds is too low, the objects being finished continuously impact against the walls of the vessel, damaging the objects and creating unnecessary wear on the vessel. The optimal ratio is quite dependent on the objects and their desired finish. For example, when finishing an object such as an airbag sensor tube, it is desirable that the sensor tube frequently impact the wall of the vessel so as to achieve a smoother finish on the inside of the tube.

One use of the prototype has been to polish zirconia balls for use in medical applications in a two-stage polishing operation. The as-machined zirconia, including lathe machine marks, is smoothed in a first polishing stage that lasts about 1.5 hours using 30 micron diamond abrasive media, then is given a high shine in a second polishing stage that lasts about 1 hour at 325 rpm using 9 micron diamond abrasive media.

Figure 5:
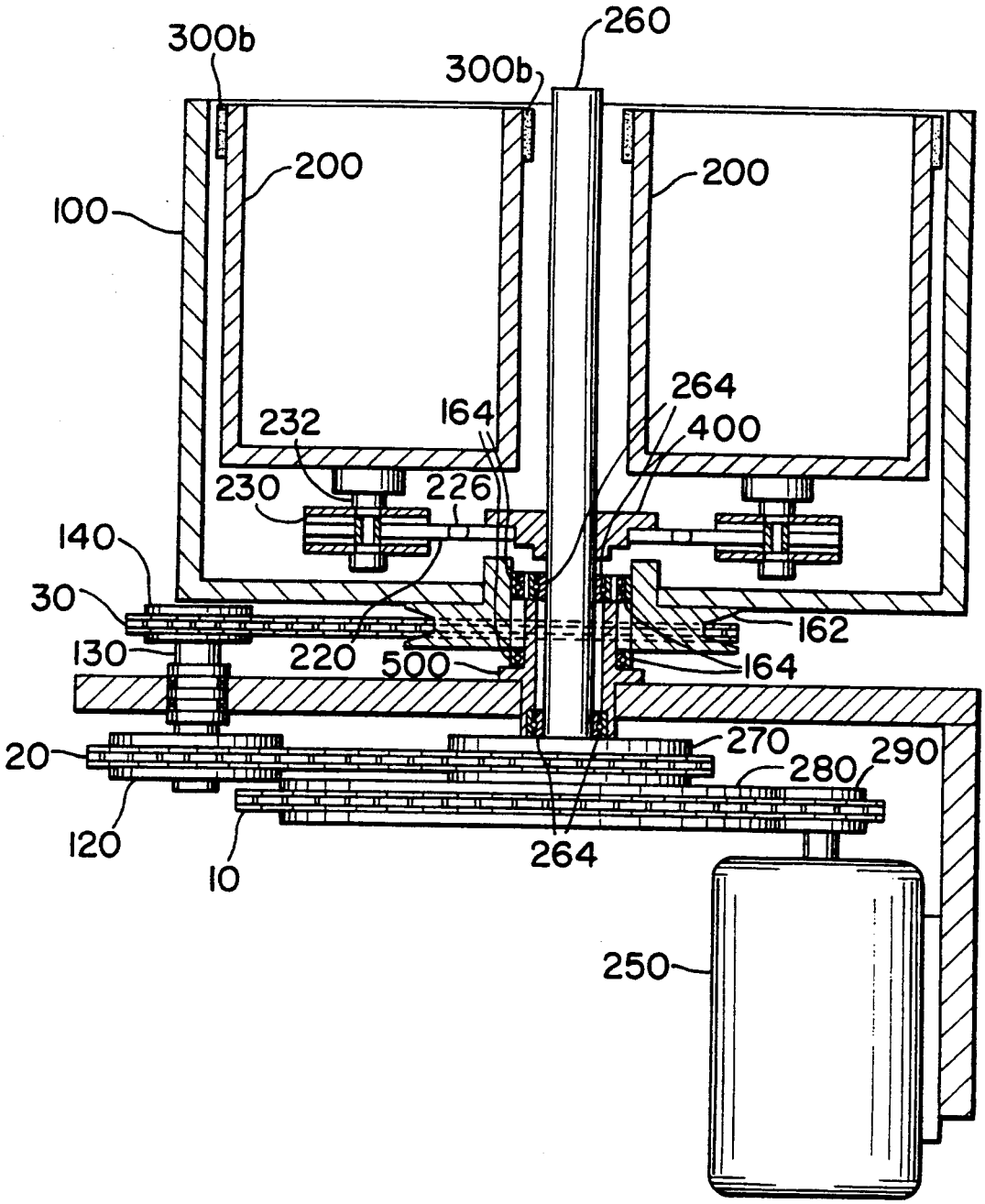
FIG. 5 is another cross-sectional view of a variation of the apparatus shown in FIG. 2B.

FIG. 5 is a cross-sectional view of a variation of the apparatus shown in FIG. 2B, in which each the outer surface of each inner vessel has a traction surface comprising a frictional member. FIG. 5 also shows a motor 250, pulleys 120, 140, 162, 270, 280 and 290, belts 10,20 and 30, and jack shaft 130 used to drive the outer vessel 100 and inner vessels 200.

Stationary member 500 is shown as having two sleeves of ball bearings 264 which constrain shaft 260 to rotational movement. A pulley 162 connected to the outside bottom of outer vessel 100 provides a channel for the belt 30 which causes rotation of the outer vessel 100. Two sleeves of ball bearings 162 are shown on the inner surface of ring 162, so that the ring 162 may move freely around stationary member 500. The inner vessel 200 is connected to bearing 230 by way of a shaft 232. The arm 220 includes a slide bearing 226 which allows the inner vessel 200 to move outwards during revolution, so that the traction surface **300*b* makes contact with the inner surface of the outer vessel 100. The slide bearing 226** is believed to be most appropriate for use with heavy loads or an inner vessel having a relatively large height.

Motor 250 turns pulley 290, which causes belt 10 to move and to turn pulley 280. Pulley 270 is attached to pulley 280, for example, by being welded thereon, and turns with pulley 280 so as to rotate shaft 260, resulting in the revolution of inner vessels 200 around shaft 260. Improved operation results from pulley 270 being in a different plane than pulley 290.

The rotation of pulley 270 moves belt 20, which turns pulley 120. Jack shaft 130 is attached to pulleys 120 and 140, and permits pulley 120 to turn pulley 140. Jack shaft 130 includes bearings 132 so that it may rotate freely in a stationary surface. The rotation of pully 140 moves belt 30 which turns pulley 162 so as to rotate the outer vessel 100.

Although the arrangement shown in FIG. 5 results in a fixed ratio of rotational speeds, a variable ration can be readily achieved using, for example, another motor to drive pulley 162 or a variable pitch pulley.

Although the bases of the inner vessels are shown at the same height, the present invention is not restricted to this, and the inner vessels may be at different heights relative to the outer vessel.

Although illustrative embodiments of the present invention, and various modifications thereof, have been described in detail herein with reference to the accompanying drawings, it is to be understood that the invention is not limited to this precise embodiment and the described modifications, and that various changes and further modifications may be effected therein by one skilled in the art without departing from the scope or spirit of the invention as defined in the appended claims.

What is claimed is:

1. A centrifugal finisher for finishing at least one object, comprising:

an outer vessel having an inner surface and an axis;

at least one inner vessel inside said outer vessel for containing said at least one object and having an outer surface;

driving means for revolving each said inner vessel around said axis of said outer vessel; and at least one traction surface of a resilient material for engaging said inner surface of said outer vessel with said outer surface of said inner vessel when each said inner vessel is revolved by said driving means, thereby causing each said inner vessel to rotate.

2. A centrifugal finisher as in claim 1, wherein said at least one traction surface comprises at least one frictional member on said inner surface of said outer vessel.

3. A centrifugal finisher as in claim 1, wherein said at least one traction surface comprises at least one frictional member on each said outer surface of each said at least one inner vessel.

4. A centrifugal finisher as in claim 1, wherein said at least one traction surface comprises at least two frictional members.

5. A centrifugal finisher as in claim 4, wherein each of said frictional members has a depth, and the depth of one of said frictional members is thicker than at least one other depth of a respective other of said frictional members.

6. A centrifugal finisher as in claim 1, further comprising a connection member, and wherein each said inner vessel also includes a base and an arm between said base and said connection member.

7. A centrifugal finisher as in claim 6, wherein said driving means rotates said connection member, thereby revolving each said inner vessel.

8. A centrifugal finisher as in claim 7, wherein said connection member is a hub at said axis of said outer vessel.

9. A centrifugal finisher as in claim 7, wherein said outer vessel has an axis and said connection member is a ring coaxial with said outer vessel.

10. A centrifugal finisher as in claim 6, wherein said arm includes a hinge.

11. A centrifugal finisher as in claim 6, wherein said arm includes a slide bearing.

12. A centrifugal finisher for finishing at least one object, comprising:

an outer vessel having an inner surface and an axis;

a connection member;

at least one inner vessel inside said outer vessel for containing said at least one object and having a base, an arm of flexible material having flexure in one direction located between said base and said connection member, and an outer surface;

driving means for revolving each said inner vessel around said axis of said outer vessel;

at least one traction surface for engaging said inner surface of said outer vessel with said outer surface of said inner vessel when each said inner vessel is revolved by said driving means, thereby causing each said inner vessel to rotate.

13. A centrifugal finisher as in claim 12, wherein said flexible material is one of spring steel or plastic.

14. A centrifugal finisher as in claim 1, wherein each said inner vessel has a size equal to a predetermined value.

15. A centrifugal finisher as in claim 1, wherein at least one said inner vessel has a size equal to a first predetermined value and at least another said inner vessel has a size equal to a second predetermined value different than said first predetermined value.

16. A centrifugal finisher as in claim 1, further comprising second driving means for rotating said outer vessel.

17. A centrifugal finisher as in claim 16, further comprising means for adjusting a speed of rotation of said second driving means.

18. A centrifugal finisher as in claim 17, further comprising means for adjusting a direction of rotation of said second driving means.

19. A centrifugal finisher as in claim 1, wherein said at least one inner vessel is also for containing abrasive media.

20. A centrifugal finisher for finishing at least one object, comprising:

an outer vessel having an inner surface and an axis;

at least one inner vessel inside said outer vessel for containing said at least one object and abrasive media and having an outer surface, said abrasive media comprising compressed felt chunks having a particulate coating;

driving means for revolving each said inner vessel around said axis of said outer vessel; and at least one traction surface for engaging said inner surface of said outer vessel with said outer surface of said inner vessel when each said inner vessel is revolved by said driving means, thereby causing each said inner vessel to rotate.

21. A method for finishing at least one object, comprising the steps of:

loading said at least one object into at least one inner vessel having an outer surface and containing abrasive media, said inner vessel being inside an outer vessel having an inner surface and an axis, and revolving said at least one inner vessel around said axis of said outer vessel so as to engage said inner surface of said outer vessel with said outer surface of said at least one inner vessel at a traction surface of a resilient material, thereby causing said at least one inner vessel to rotate.

22. A method for finishing as in claim 21, wherein said traction surface is on said outer surface of said inner vessel.

23. A method for finishing as in claim 22, wherein said traction surface comprises at least one frictional member.

24. A method for finishing as in claim 21, wherein said traction surface is on said inner surface of said outer vessel.

25. A method for finishing as in claim 24, wherein said traction surface comprises at least one frictional member.

26. A method for finishing as in claim 21, wherein said outer vessel includes a connection member, each said inner vessel includes a rotatable base and an arm between said rotatable base and said connection member, and wherein the step of revolving said at least one inner vessel comprises rotating said connection member.

27. A method for finishing as in claim 26, wherein said rotatable base includes a bearing for rotating said inner vessel when it is engaged with said traction surface.

28. A method for finishing as in claim 21, further comprising a step of rotating said outer vessel.

29. A method for finishing as in claim 28, wherein said inner vessel has a first speed of rotation, said outer vessel has a second speed of rotation, and said first speed of rotation has a different value than said second speed of rotation.

30. A method for finishing as in claim 28, wherein said inner vessel has a first direction of rotation, said outer vessel has a second direction of rotation, and said first direction of rotation is counter to said second direction of rotation.

31. A method for finishing as in claim 28, wherein said inner vessel has a first direction of rotation, said outer vessel has a second direction of rotation, and said first direction of rotation is the same as said second direction of rotation.

32. A method of finishing as in claim 21, wherein the step of revolving includes the steps of: revolving for smoothing said at least one object for a first predetermined time using first abrasive media to produce as least one smoothed object, and revolving for shining said at least one smoothed object for a second predetermined time using second abrasive media.

33. A method of finishing as in claim 32, wherein said first abrasive media has a first size, said second abrasive media has a second size, and said first size is larger than said second size.

34. In a process for operating a centrifugal finisher, the steps comprising:

revolving an inner vessel within an outer vessel;

engaging said inner vessel, while revolving the same, with said outer vessel by means of a traction surface of a resilient material on either the outer vessel or the inner vessel, thereby causing said inner vessel to rotate; and establishing a prolate cycloid relationship based on rotational and revolutional movement of the inner and outer vessels such that the relationship is chosen from one where the outer vessel is stationary, is rotating counter to the rotation of the inner vessel, or is rotating in the same direction as the inner vessel.

35. A process for operating a centrifugal finisher as in claim 34, wherein said inner vessel has a rotational speed in the range 150–6000 rpm.

36. A process for operating a centrifugal finisher as in claim 34, wherein said inner vessel has a rotational speed and a revolutional speed, and said rotational speed is controlled separately from said revolutional speed.

* * * * *